US005271739A

United States Patent [19]

Denlinger et al.

[11] Patent Number: 5,271,739

[45] Date of Patent: Dec. 21, 1993

[54] SYSTEM FOR ATTACHING WIRE SHIELD TO PLUG

[75] Inventors: Keith R. Denlinger, Lancaster; John M. Myer, Millersville, both of Pa.

[73] Assignee: The Whitaker Corporation, Wilmington, Del.

[21] Appl. No.: 973,013

[22] Filed: Nov. 6, 1992

[51] Int. Cl.[5] ..... H01R 13/58

[52] U.S. Cl. ..... 439/466; 439/902

[58] Field of Search ..... 439/466, 468, 473, 751, 439/465, 686, 694, 701, 902

[56] References Cited

U.S. PATENT DOCUMENTS

| | | | |
|---|---|---|---|
| 3,920,306 | 11/1975 | Barnett, Jr. et al. | 439/466 X |
| 4,005,921 | 2/1977 | Hadden et al. | 439/466 |
| 4,168,877 | 9/1979 | Little et al. | 439/466 X |
| 4,412,714 | 11/1983 | Morningstar et al. | 439/466 X |
| 4,431,249 | 2/1984 | Frantz et al. | 439/466 X |
| 4,552,423 | 11/1985 | Swengel, Jr. . | |
| 4,605,269 | 8/1986 | Cohen et al. . | |
| 4,806,109 | 2/1989 | Manabe et al. . | |

FOREIGN PATENT DOCUMENTS

| | | | |
|---|---|---|---|
| 1604425 | 12/1981 | United Kingdom | 439/466 |

*Primary Examiner*—Peter Dungba Vo

*Attorney, Agent, or Firm*—Bruce J. Wolstoncroft

[57] ABSTRACT

A system for attaching a wire shield and a cover cap to the rear of an electrical plug. The plug is provided with four U-shaped members extending outwardly from the periphery of the plug casing, two on each of the opposite sides of the casing, near its corners. Four latching prongs extend forwardly from the shield, in alignment with the U-shaped members, each of which when advanced into a U-shaped member engages a detent shoulder on the inside of the top of the U-shaped member, to accomplish the desired latching. The cap, if used, has four forwardly-extending latching prongs each positioned to slide into a U-shaped member, just below the shield-latching prongs, until it engages a detent shoulder on the casing below the shield prong. Support structure integral with the U-shaped member preferably provides support to hold the shield latches in place even if the cap prongs are not present, as when a cap is not used.

8 Claims, 7 Drawing Sheets

SYSTEM FOR ATTACHING WIRE SHIELD TO PLUG

FIELD OF THE INVENTION

This invention relates to systems for attaching a wire shield to an electrical plug, and especially to such systems in which a cap may be placed over the rear of the plug, between the wire shield and the plug.

BACKGROUND OF THE INVENTION

Systems are known in the prior art in which a plug carries a large number of electrical contacts which are accessible from its front side to complete a plug-in connection, and which is provided at its rear side with corresponding multiple contacts each adapted to be secured to a wire or lead. It is also known to provide a closure cap through which the wires extend, and which is adapted to be secured to the rear side of the plug. Also often provided is a so-called wire shield, which is secured to the plug behind the cap, and serves to hold the wires in an appropriate wire dress and also relieves stress on the connections to the plug contacts if the wires are pulled or otherwise stressed. For convenience, these wire shields have been made so that they are latchable to the casing of the connector plug.

In some significant cases, the space available on the casing for the plug for securing the wire shield and/or the cap to it is minimal. This is particularly true of modular plugs which are designed to be plugged side-by-side into a common header, whereby the sides of the plug casings are not readily available to accommodate latching structures for securing the wire shield and the caps. In addition, the bottom of the plug casing often includes other integral structures, such as latches used for other purposes. It has therefore become desirable in some applications to provide structures for latching a wire shield, and preferably also a rear cover cap, to a multi-contact plug, which structures occupy only a small portion of the plug casing. It is also desirable that the latching arrangement be capable of securing the wire shield without the cap, when a cap is not used.

SUMMARY OF THE INVENTION

In accordance with the invention, a system is provided which comprises a multi-contact connector plug having a front side which is adapted to mate with a multi-contact header and a rear side which adapted to receive a plurality of wires, and which also comprises a plug casing extending around the periphery of the plug to which a wire shield and, optimally, a rear cover cap are latched. In accordance with the invention, the wire shield is attached by a plurality of latching prongs which extend forwardly toward a corresponding plurality of U-shaped members on the exterior of the plug casing, into which the prongs are inserted to accomplish the desired latching operation. Each of the U-shaped members comprises a first detent shoulder on the inside of its top, and each of said prongs has a lateral projection or hook at its forward end which is adapted to extend about its corresponding detent shoulder when the prong is advanced sufficiently into the U-shaped member, thereby to provide latching. A support for the shield prong is preferably also provided in each U-shaped member, which may take the form of one or more side rails or shoulders along which the shield prong slides during insertion into the U-shaped member, the thickness of the prong being sufficiently great, at least in portions thereof rearward of its lateral projection, to hold the projection in its latched condition once it moves into latched position.

In the preferred embodiment which also includes a latching arrangement for the optional rear cover cap, the plug casing beneath each U-shaped member is also provided with an upstanding cap-latching detent shoulder designed to receive and latch a corresponding cap-latching prong which extends forwardly from the cap and, as the cap is advanced, slides beneath the position allotted to the shield-latching prong until a downwardly-extending lateral projection at the forward end of the cap-latching prong moves into position beyond the cap-latching shoulder to hold the cap in place. Preferably there are four such U-shaped members and four of each type of latching prong, two on each opposite side of the casing, one near each corner thereof.

In the preferred embodiment, the support for each wire-shield prong comprises at least one, and preferably two, shoulders formed on the plug casing along each inner sidewall of the U-shaped member, on top of which shoulder or shoulders the shield prong slides when moving into latched position, to hold the shield prong in latched position even if the cap prong is not present. Such shoulders are not essential when the cap prong is used, since the top of the cap prong, in its latched position, can serve to support the shield prong in its latched position; in this case the maximum thickness of the shield prong plus the maximum thickness of the cap prong is preferably slightly less than the interior height of the U-shaped member.

BRIEF DESCRIPTION OF FIGURES

These and other objects and features of the invention will be more readily understood from a consideration Of the following detailed description, taken with the accompanying drawings, in which.

DETAILED DESCRIPTION OF PREFERRED EMBODIMENT

Figure 1:
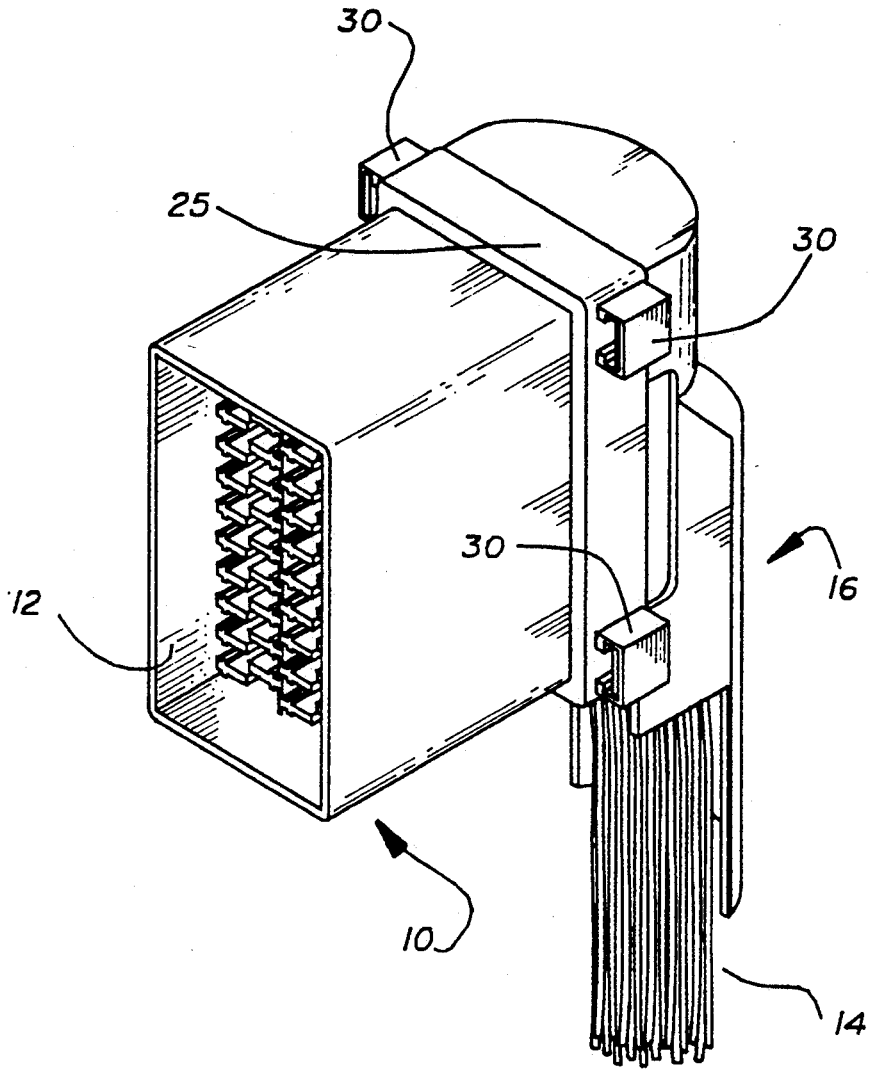
FIG. 1 is a perspective view of a combination of a plug connector and a wire shield, secured together by the attachment system of the preferred embodiment of the present invention.
Figure 2:
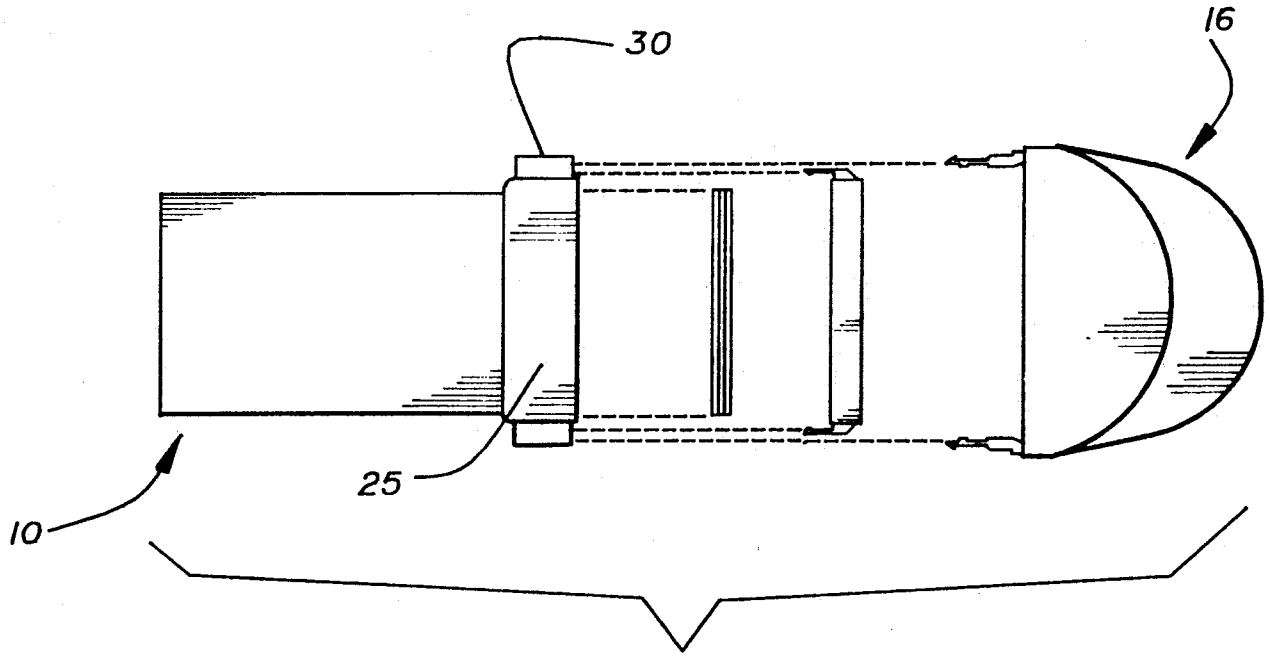
FIG. 2 is a top plan view of the system shown in FIG. 1.
Figure 3:
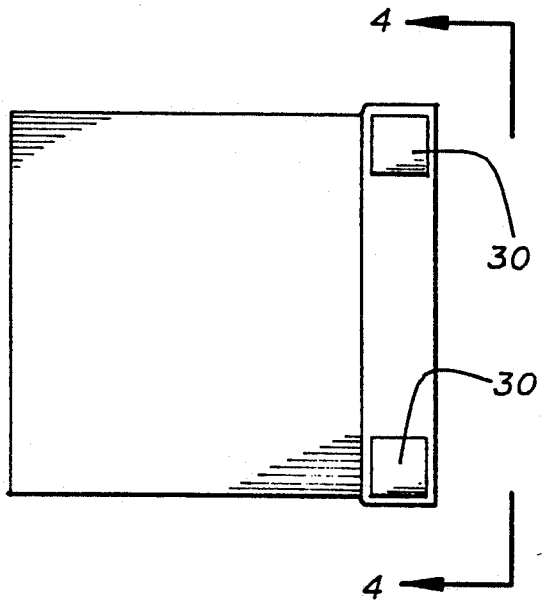
FIG. 3 is a top plan view of the plug shown in the system of FIG. 1.
Figure 4:
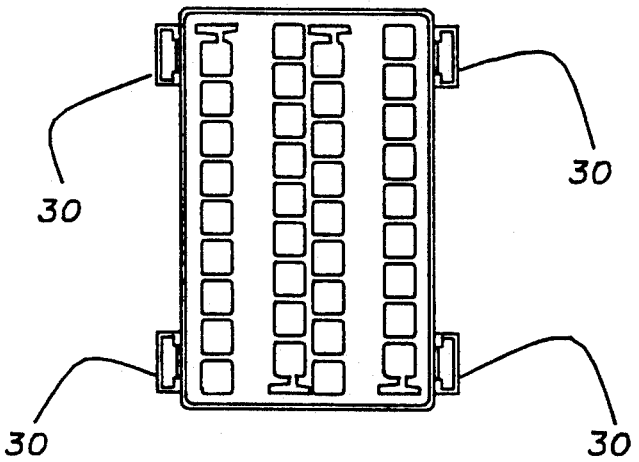
FIG. 4 is a front elevational view of the connector shown in FIG. 1.
Figure 5:
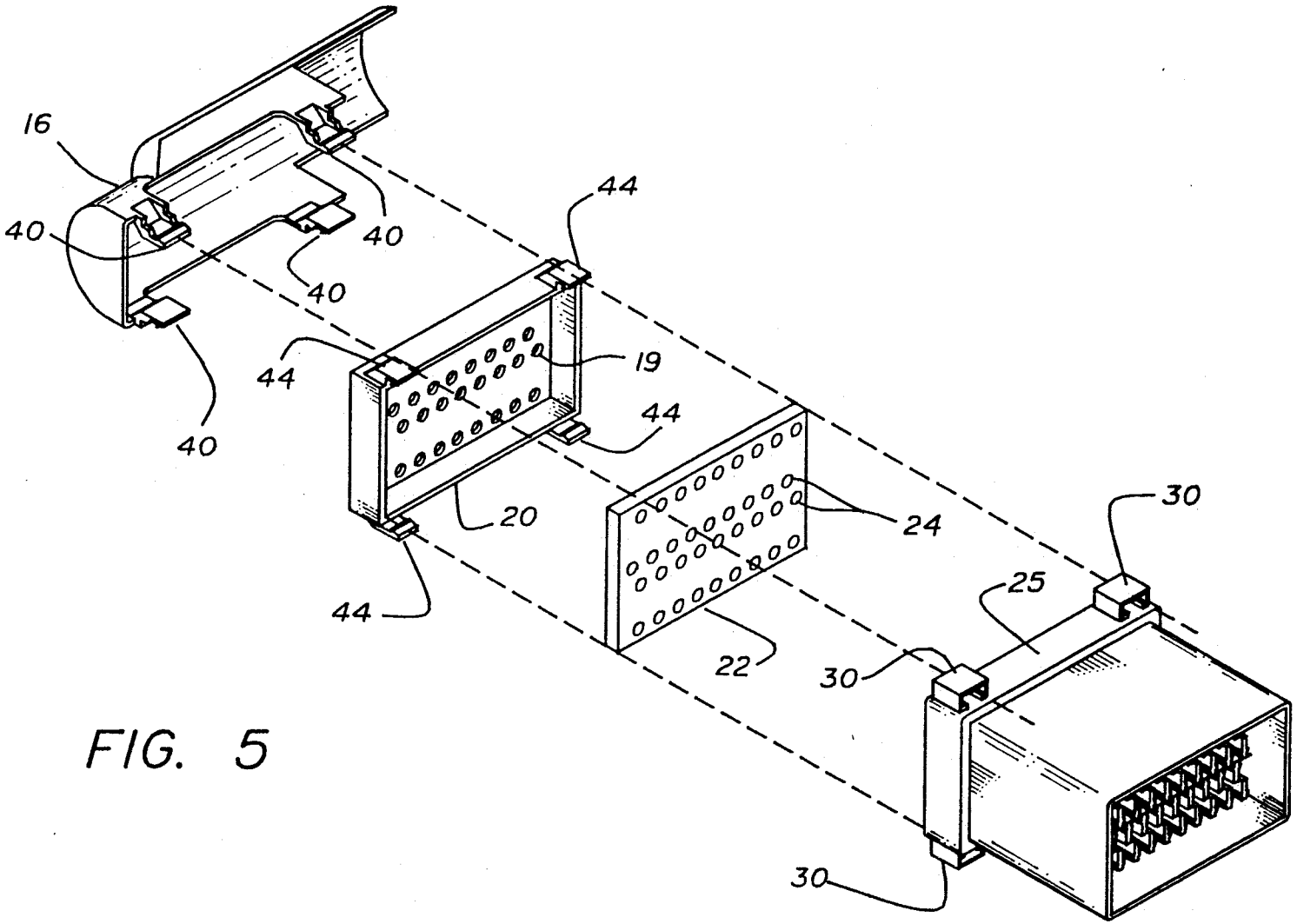
FIG. 5 is an exploded perspective view of the system of FIG. 1.

Referring now to the preferred embodiment of the invention shown in the drawings by way of example only, and without thereby in any way limiting the scope of the invention, FIG. 1 shows a connector plug 10 for presenting at its open end 12 a plurality of contacts which may be plugged into a header along with a number of similar plugs, side-by-side. The various wires 14 extend through a wire shield 16 (FIG. 5) to the rear of the contacts in plug 10, where they are electrically connected in conventional manner. FIG. 5 also shows conventional openings, such as 19 in a cap 20 which is adapted to be secured to the rear of the plug 10, and a resilient gasket 22 of relatively soft material which contains corresponding openings 24, and which serves as a seal between the cap and the rear of the plug. Each of the wires shown in FIG. 1 extends through a different one of the holes 19 and 24 on cap 20 and gasket 22. Since the portion of the connector assembly thus far described may be entirely conventional it is not necessary to describe it in further detail.

In accordance with the invention there are provided, on the exterior periphery of the plug casing 25 a plurality, in this case four, of U-shaped members 30; in this preferred embodiment, there are two such U-shaped members on the top of the casing near its corners, and a corresponding pair on the bottom of the casing near its side corners. The present invention is primarily concerned with the manner in which the wire shield 16 is latched to the connector plug 10, in which the cover cap 20 can also be secured to the rear of the plug casing; in this connection it will be understood that in some embodiments one may not need to use the cover cap 20, and it may be eliminated entirely, in which case the wire shield will still be latched securely to the rear of the plug casing.

Each of the U-shaped members, with its special interior configuration, is adapted to receive and to latch a corresponding one of the forwardly-extending shield latching prongs 40 on the wire shield 16; in this example, using four U-shaped members, there are four corresponding shield latching prongs. Each is latched inside its corresponding U-shaped member merely by advancing it fully into the U-shaped member, as will be described more fully hereinafter.

When a cap 20 is employed, its corresponding four cap latching prongs 44 extend forwardly in alignment with their respective corresponding U-shaped members, and are secured thereto merely by advancing them until they are fully inserted into their respective U-shaped members.

Figure 7:
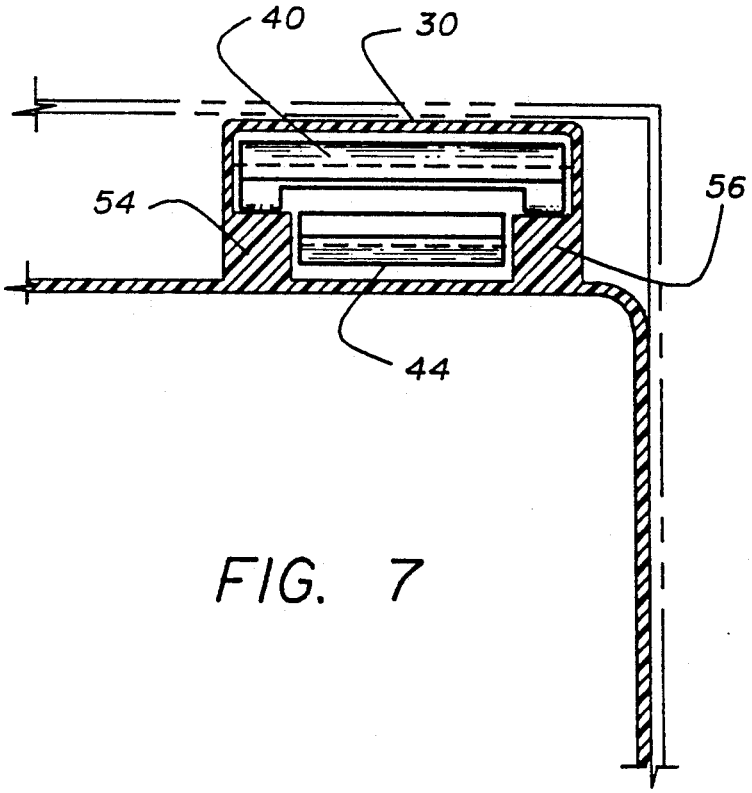
FIG. 7 is a sectional view taken along lines 7—7 of FIG. 6.
Figure 8:
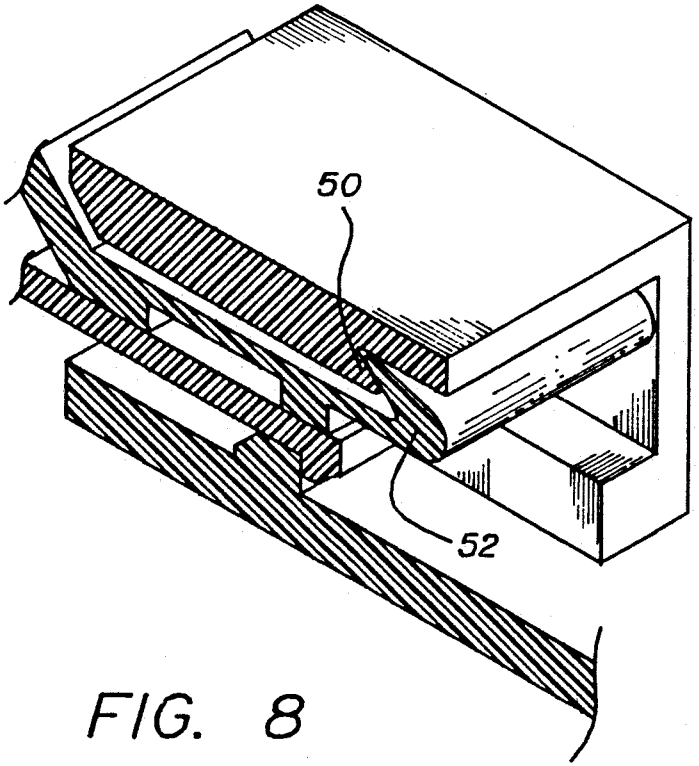
FIG. 8 is a fragmentary perspective view, in section, showing of the latching arrangement according to a preferred embodiment of the invention.
Figure 9:
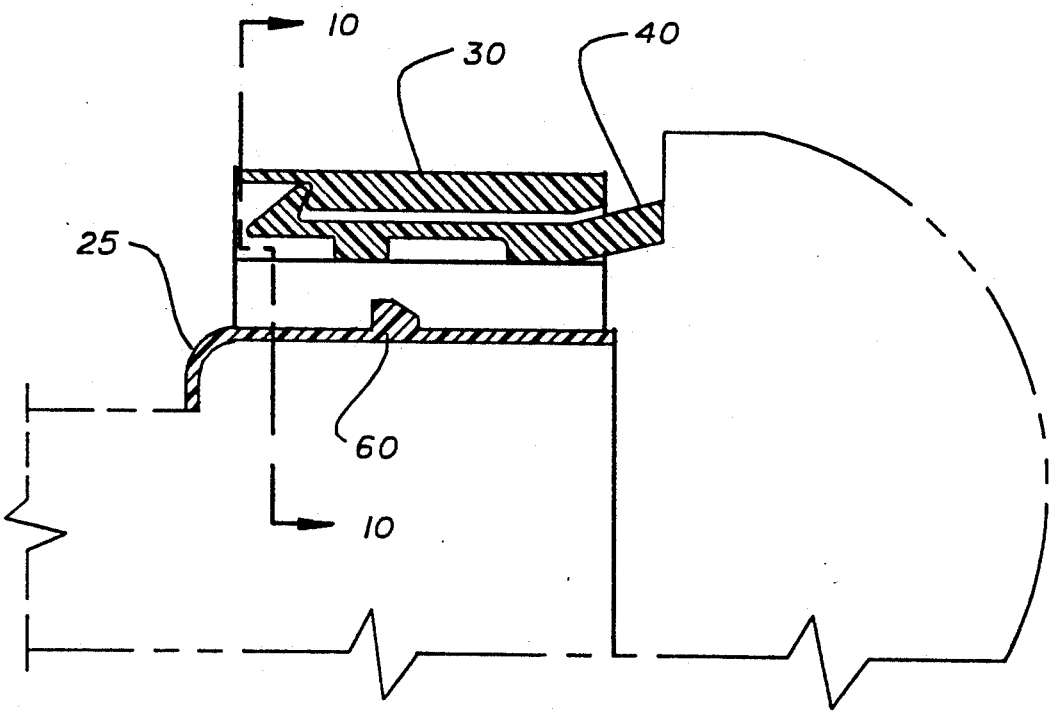
FIG. 9 is a view like that of FIG. 6, but with the cap latching prong removed.
Figure 10:
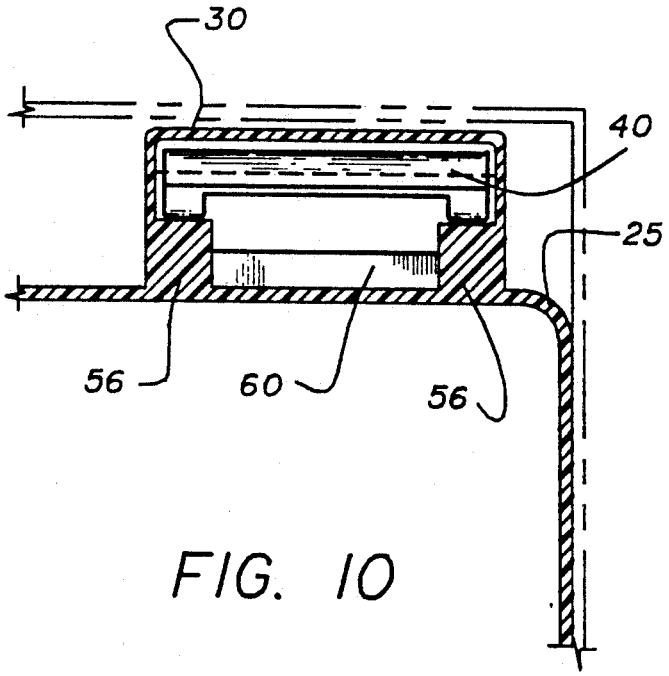
FIG. 10 is a view like that of FIG. 7, but again with the cap latching prong removed.

The details of how this latching occurs inside the U-shaped frames are shown in more detail in FIGS. 6–10. Each of these figures shows the same latching structure, but FIGS. 9 and 10 show it with only the shield prongs inserted, that is, with the cap latching prongs absent, as is the case when a cap is not used.

Figure 6:
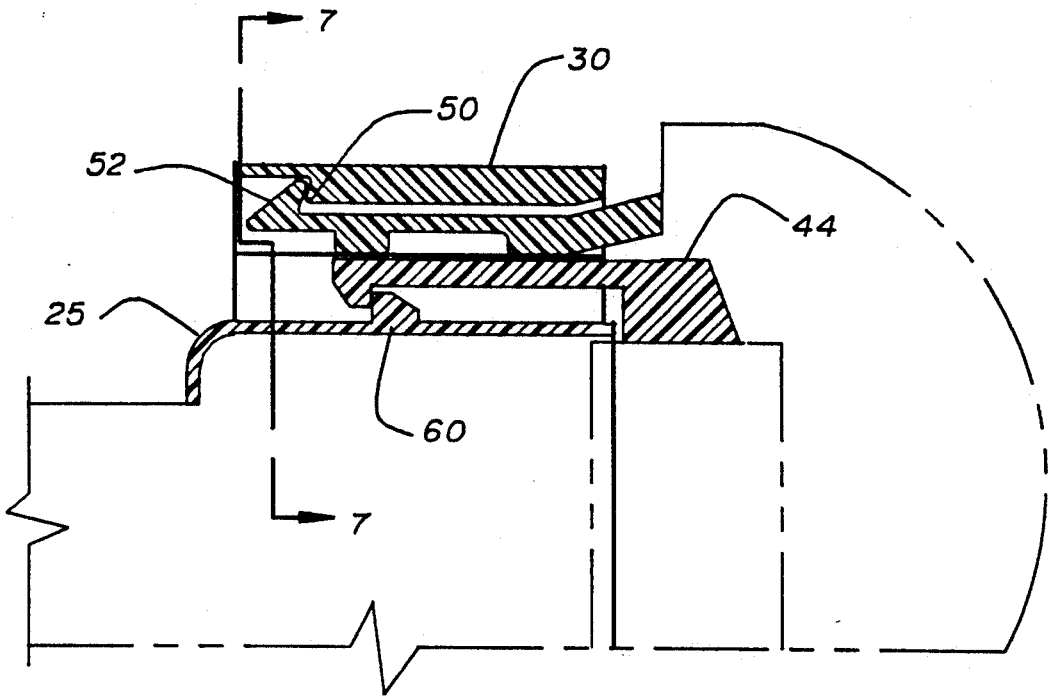
FIG. 6 is an enlarged, fragmentary vertical sectional view showing structure included in the broken line circle of FIG. 2.

Referring now to these figures, and first especially FIGS. 6–8, it is seen that the U-shaped member 30 has on the underside its top a detent shoulder 50, about which a lateral projection or hook 52 on the distal end of the shield prong 40 is placed by moving the shield to the left as viewed in FIG. 6; preferably the wire prong is shaped so as to be spring-biased outwardly, whereby as it is being inserted into the U-shaped member it presses against the inside of the top of the U-shaped member and, finally, snaps into the position shown when the prong is fully inserted.

While such spring action in itself may be sufficient for some purposes, in the absence of additional support there is a substantial possibility that the latching mechanism may on occasions release itself undesirably, for example due to vibration, or to stress on the wires. Accordingly, one of several possible types of support are provided. In the preferred embodiment of FIGS. 6–8, such support is provided by the pair of side shoulders or rails 54 and 56 located along opposite sides of the U-shaped member and preferably formed integrally therewith and with the outer casing 25 of the connector plug. The portion of the shield prong adjacent its laterally projecting head 52 is preferably relatively thin to provide a certain amount of flexibility to the prong, while at least portions of the remainder, or rearward, portion of the wire prong are thicker, so as to substantially fill the space between the side support rails 54, 56 and the inside of the top of the U-shaped member, thus preventing the latch from releasing once the prong is inserted into the U-shaped member. It is also possible to eliminate the support rail on either side, and rely upon a single support located on only one side of the U-shaped member, although this is not preferred.

FIGS. 9 and 10 illustrate that the support provided at both sides of the U-shaped member is adequate to hold the shield latch in place whether or not there is a cap prong present; that is, FIGS. 9 and 10 show an arrangement without the cap prong, with the shield prong nevertheless held securely in latched position.

In FIGS. 6–8 the cap prong 44 is shown fully inserted into its latched position. To accomplish latching, a latching detent shoulder 60 is provided in the form of a rib extending across the bottom wall of the U-shaped member, i.e. the top of the plug casing beneath the U-shaped member, and this cap prong is provided with a downwardly projecting portion or hook 62 which, when inserted into the U-shaped member, will advance until it moves beyond and around the detent shoulder 60 and is thereby secured in its latched position as shown in FIGS. 6–8.

When the cap and cap prongs are utilized, it is possible to dispense with the special support means for the shield prong and use the top of the cap prong as the support. That is, one may slide the cap prongs forward into the latched position shown, and then advance the wire shield prongs forwardly into the U-shaped members so that the thickened portions thereof slide along the top of the already-inserted cap latch until the shield latch snaps into its latched position.

There has therefore been provided a system which permits securing a wire shield to the rear of a plug by simply advancing specially-formed, forwardly-projecting latching prongs on the wire shield into corresponding U-shaped members on the periphery of the plug casing; also provided is an arrangement by which the cap may be secured using cap prongs extending forwardly and into the same U-shaped members, preferably beneath the shield latching members. Special support means are preferably provided in the U-shaped members so that, especially in the event that no cap is used, the latching prongs will still be effective to secure the wire shield in position as desired.

While the invention has been described with particular reference to specific embodiments in the interest of complete definiteness, it will be understood that it may be embodied in a variety of forms diverse from those specifically shown and described, without departing from the spirit and scope of the invention.

What is claimed is:

1. In a system comprising a multi-contact connector plug having a front side which is adapted to mate with a multi-contact header, a rear side which is adapted to receive a plurality of wires, and a plug casing extending around its periphery; a cap securable to said casing to cover the rear of said plug; a wire shield securable to said casing behind said cap, for encompassing said wires; and an attachment structure for securing said cap and said wire shield to said casing; the improvement wherein:

said attachment structure comprises a plurality of U-shape members spaced about, and protruding outward from, the of said plug casing;

a plurality of shield-latching prongs each projecting forwardly from said wire shield toward one of said U-shaped members and insertable therein to secure said wire shield to said connector plug;

a plurality of cap-latching prongs each projecting forward from said cap toward one of said U-shaped members and insertable therein to secure said cap to said connector plug;

each of said U-shaped member comprising a first detent shoulder on an inside surface of a top wall and each of said shield-latching prongs having a lateral projection at its forward end adapted to fit about said shoulder when advanced into its corresponding, aligned, U-shaped member and thus secure said wire shield to said plug connector;

a second shoulder on said plug casing beneath each of said U-shaped members, each of said cap-latching prongs having at its forward end a lateral projection facing said casing and adapted to fit about said second shoulder when advanced into its corresponding U-shaped member, and thus secure said cap to said plug connector.

2. The system of claim 1, wherein each of said shield-latching prongs has a narrow neck portion adjacent said lateral projection and a thicker portion more remote from said lateral projection.

3. The system of claim 1, wherein said casing is rectangular in cross-section, and said U-shaped member are four in number and each positioned adjacent a different corner of said casing.

4. The system of claim 1, wherein said casing has parallel sides enabling it to fit closely beside another similar casing.

5. The system of claim 1, wherein said structure comprises at least one support integral with said casing and within one of said U-shaped members for supporting one of said shield prongs when it is positioned in said one U-shaped member.

6. The system of claim 5, wherein said support comprises a pair of shoulders, positioned on respective sides below the bottom surface of said shield prong.

7. The system of claim 5, wherein said support comprises only one shoulder in each U-shaped member, positioned below the bottom surface of said shield prong.

8. A connector plug having a front side which is adapted to mate with a mating connector, a rear side which is adapted to receive a plurality of wires, the connector has a first member securable to the plug; a second member securable to the plug behind the first member; and an attachment structure for securing the first and second members to the connector plug; the connector plug comprising:

the attachment structure has a plurality of U-shaped members spaced about, and protruding outward from, the periphery of the connector plug;

a plurality of first member latching prongs each projecting forwardly from the first member toward one of the U-shaped members nd insertable therein to secure the first member to the connector plug;

a plurality of second member latching prongs each projecting forwardly from said second member toward one of the U-shaped members and insertable therein to secure the second member to the connector plug;

each of the U-shaped members having a first detent shoulder on the inside of its top, and each of the first member latching prongs having a lateral projection at its forward end adapted to fit about said shoulder when advanced into its corresponding, aligned, U-shaped member and thus secure the first member to the plug connector;

a second shoulder on the plug connector beneath each of the U-shaped members, each of the second member latching prongs having at its forward end a lateral projection facing the connector plug and adapted to fit about said second shoulder when advanced into tis corresponding U-shaped member, and thus secure the second member to the plug connector.

* * * * *